United States Patent [19]

Newport

[11] 4,182,032

[45] Jan. 8, 1980

[54] COMBINATION FORK DEVICE

[76] Inventor: Duane B. Newport, 4611 Dodge, Fort Wayne, Ind. 46805

[21] Appl. No.: 889,098

[22] Filed: Mar. 22, 1978

[51] Int. Cl.[2] ..... A47J 43/28

[52] U.S. Cl. ..... 30/137

[58] Field of Search ..... 30/137, 142, 147, 148, 30/322; 294/7, 8, 49, 50.5, 50

[56] References Cited

U.S. PATENT DOCUMENTS 2,839,830 6/1958 Neiman ..... 30/147

FOREIGN PATENT DOCUMENTS 30350 of 1897 United Kingdom ..... 30/137

10089 of 1901 United Kingdom ..... 30/137

*Primary Examiner*—Jimmy C. Peters

*Attorney, Agent, or Firm*—Gust, Irish, Jeffers & Rickert

[57] ABSTRACT

A fork having a finger operated assist blade pivotally attached thereto such that it is movable sideways against the outer tine of the fork in a lateral direction. The assist blade, which is spring biased outwardly, is higher than the fork tines so that food will be pushed on the fork as it moves inwardly.

8 Claims, 5 Drawing Figures

COMBINATION FORK DEVICE

BACKGROUND OF THE INVENTION

The present invention relates to a combination fork and in particular to means for assisting in the loading of food onto the tines of the fork.

Many persons who are handicapped such that the full use of their hands is impaired or are afflicted with a debilitating disease such as arthritis often experience considerable difficulty in manipulating eating utensils. This is also a problem with many older persons where the onset of advancing years has seriously reduced their manual dexterity and coordination. This makes eating considerably more difficult for them than for the average person and is often a source of embarrassment when eating in public.

Utensils have been devised for use by handicapped persons, for example, specially constructed knives which enable persons having the use of only one hand to effectively cut meat and other types of food which require cutting before they can be eaten. Nothing has been devised, however, to assist persons of reduced manual dexterity in loading food on a fork. Certain foods such as corn are more difficult to pick up with a fork since the kernels collectively lack cohesiveness and will tend to be pushed about on the plate by the fork before they can finally be scooped up.

SUMMARY OF THE INVENTION

The present invention overcomes the disadvantages and deficiencies of standard eating utensils such as forks when used by handicapped persons by providing a finger operated assist arm which may be moved laterally such that food may be pushed by it onto the tines of the fork.

More specifically, the present invention contemplates a combination fork comprising a body having an elongated handle and a plurality of generally parallel tines extending oppositely from the handle in the lengthwise direction and being spaced apart laterally across the width of the fork so that their upper surfaces are adapted collectively to support a quantity of food. An assist arm is movably connected to the fork body and includes means for moving a blade, a portion of which extends above the level of the tine upper surfaces, sideways against the outer tine in a lateral direction.

It is an object of the present invention to provide a combination fork device having a pivotally mounted assist blade with an operating lever positioned for easy operation when the fork is held in the customary manner.

It is also an object of the present invention to provide a combination fork device having an assist blade biased to an open position so that it can be operated by the hand which holds the fork with a single manual action.

It is a further object of the present invention to provide a combination fork device having an assist blade which may be held against one of the outer tines so that it will not interfere with insertion of the fork in the user's mouth.

Another object of the present invention is to provide a combination fork device having means for assisting in loading food on the tines which is relatively unobtrusive in appearance.

A still further object of the present invention is to provide a combination fork device which is simple in construction and economical to produce.

These and other objects of the present invention will be apparent from the following description of the preferred embodiment considered together with the appropriate drawings.

DESCRIPTION OF THE PREFERRED EMBODIMENT

Figure 5:
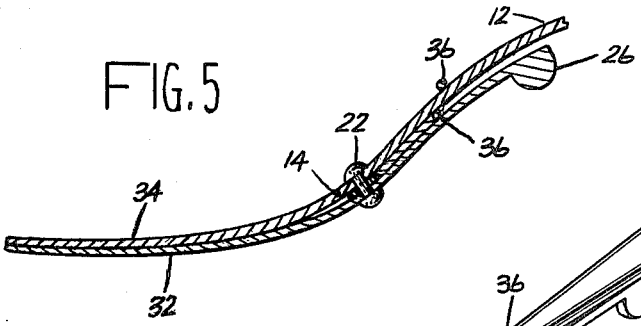
FIG. 5 is a fragmentary sectional view taken along line 5—5 of FIG. 2 and viewed in the direction of the arrows.

Referring now to the drawings, the present invention includes a fork 10 of standard construction and design having a handle 12 and a shank portion 14 which terminates in a plurality of tines 16. Tines 16 are generally parallel and pointed so that food may be pierced thereby or alternatively supported on the tine upper surfaces 18. Although a fork having four tines is shown, it may have any number of tines in excess of one. The fork 10 may be made of any suitable material and or stainless steel, silver or even plastic.

Figure 4:
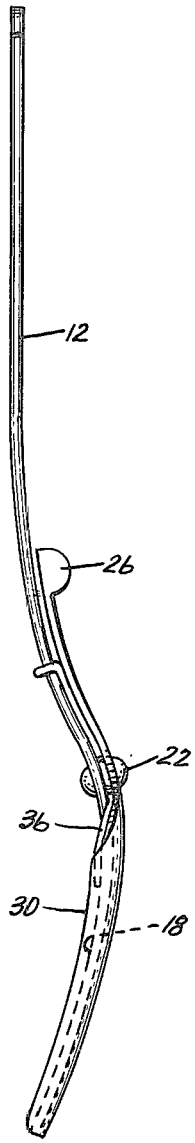
FIG. 4 is a side elevational view of the combination fork with the assist blade in the position shown in FIGS. 1 and 2.

An assist arm 20 is pivotally secured to fork 10 by means of a rivet 22 which passes through the blade portion center portion 24 and fork shank 14 as best shown in FIG. 4. Of course, the use of a rivet for attaching assist arm 20 is merely exemplary and any other suitable means such as a nut and bolt or threaded screw may be employed. Assist arm 20 comprises an operating lever 26, central portion 24 and a blade 28 which are integral with one another and preferably made of the same material as fork 10.

As shown in the figures, blade 28 is bent so as to form an upstanding portion 30, which extends above the level of the upper surfaces 18 of tines 16, and a lower portion 30 which forms an angle of approximately 90° with upstanding portion 30. Blade portion 32 together with the blade center portion 24 are shaped such that they conform to the longitudinal contour of the fork and extend beneath and in close proximity to shank 14 and one of the outer tines 34 as best shown in FIGS. 4 and 5.

Figure 1:
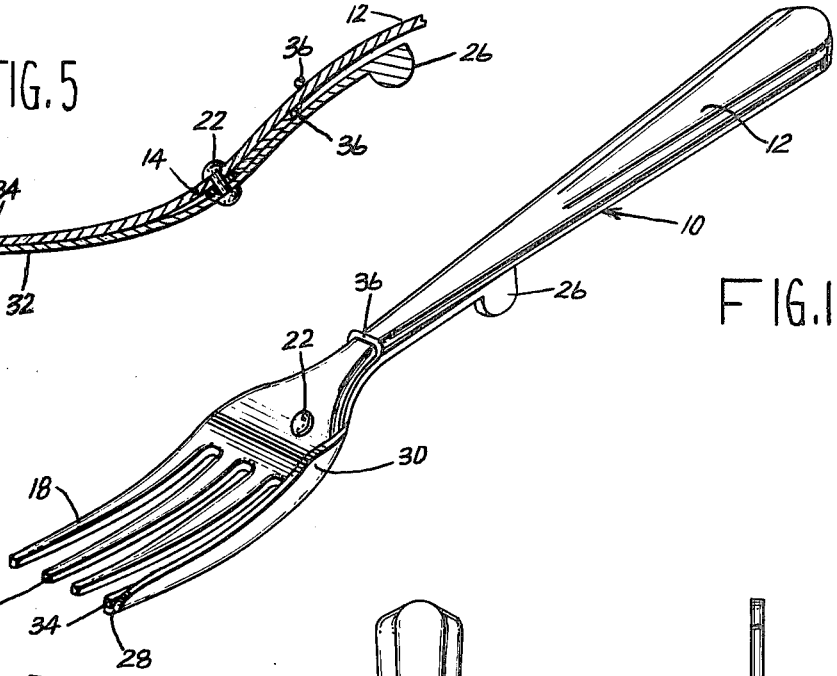
FIG. 1 is a perspective view of the combination fork according to the present invention with the assist blade positioned against one of the outer tines.
Figure 2:
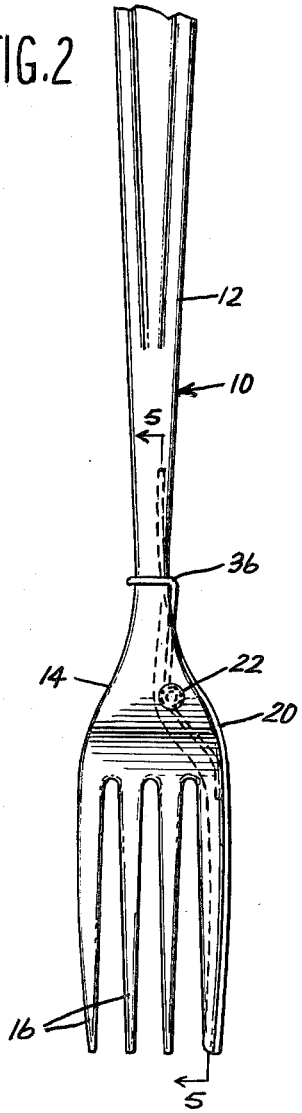
FIG. 2 is a top plan view of the aforementioned combination fork again with the assist blade positioned against one of the outer tines.
Figure 3:
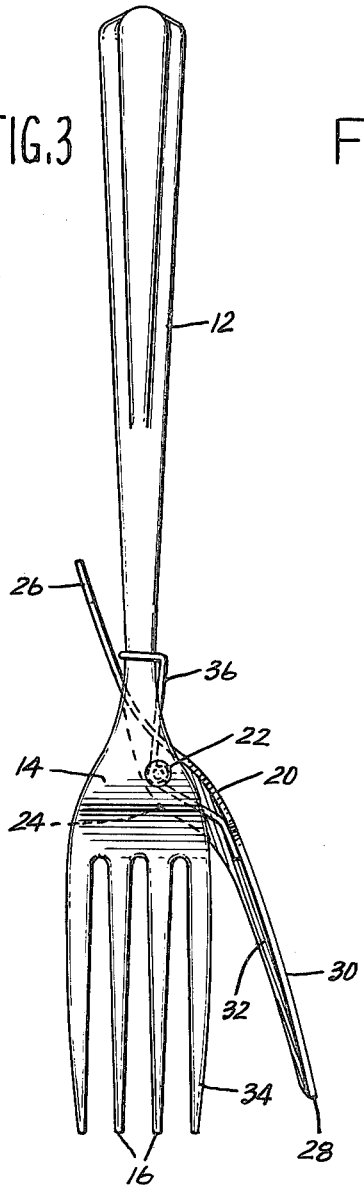
FIG. 3 is a top plan view of the combination fork with the assist blade urged laterally outward away from the tines.

Assist arm 20 extends diagonally across and underneath fork 10 and is maintained in its open position (FIG. 3) by means of a spring 36 which hooks around the lower portion of fork handle 12, coils around rivet 22 and terminates against the upstanding portion 30 of blade 28. Spring 36 is always under a certain amount of tension and urges assist blade 28 laterally outward away from outer tine 34 to the position shown in FIG. 3. By pulling lever 26 inwardly to the position shown in FIGS. 1 and 2, blade 28 will swing inwardly against outer tine 34. When pressure on lever 28 is released, spring 36 will again open blade 28.

In use, the fork 10 is held in the customary manner such that the handle 12 rests on the user's middle finger and extends between the thumb and index finger. When the fork is held in this manner, operating lever 26 is conveniently located such that it can be pulled inwardly by the user's index finger. The fork is then manipulated to position food between outer tine 34 and assist blade 28. By moving lever 26 inwardly, the upstanding portion 30 of assist blade 28 will push the food before it onto the upper surfaces 18 of tines 16. Assist blade 28 is held in this position as the fork is inserted into the user's mouth and then released prior to picking up the next portion of food. Due to the shape of assist blade 28, which conforms to the contour of the fork shank 14 and tines 16, no interference with normal eating will be experienced.

Certain modifications to the preferred embodiment described herein may be made without departing from the spirit and scope of the invention. For example, the assist arm and spring may be modified so that the arm will close by the action of the spring and open when the operating lever is either pushed or pulled by the user. Also, the combination fork may be modified for left-handed use by merely reversing the shape and positioning of the assist arm.

While this invention has been described in terms of a specific device, it should be understood that this description is made only by way of example and not as a limitation to the scope of the invention.

What is claimed is:

1. A combination fork comprising:

a body having an elongated handle and plurality of generally parallel tines extending oppositely from said handle in a lengthwise direction:

said tines being spaced apart laterally across the width of said fork and having paralled upper surfaces which are adapted collectively to support a quantity of food, one of said tines being an outer tine which is adjacent to only one other tine;

an assist blade movably connected to said fork body and having a portion extending above the level of said tine upper surfaces;

means for laterally moving said assist blade sideways from a first position removed from said outer tine to a second position wherein said blade is substantially contiguous with said outer tine along substantially its entire length, whereby a food quantity between said blade in said first position and said outer tine is moved laterally over said tine upper surfaces under the force of said blade portion as said blade is moved laterally to said second position.

2. The combination fork of claim 1 wherein said assist blade is pivotally attached to said fork body.

3. The combination fork of claim 1 wherein said assist blade is pivotally attached to said fork body at a point between sand handle and said tines, and said means for moving said blade includes an operating lever rigidly connected to said blade and which extends diagonally across said fork body.

4. The combination fork of claim 3 and including a spring engaging said assist blade, said assist blade being resiliently biased laterally outward and away from said outer tine by said spring.

5. The combination fork of claim 1 wherein said assist blade terminates in an operating lever and has a free end adjacent to said outer tine and wherein said assist blade is pivotally attached to said fork body at a point intermediate said operating lever and free end.

6. The combination fork of claim 5 and including spring means engaging said assist blade for urging said blade laterally outward and away from said outer tine.

7. The combination fork of claim 6 including a pivot pin extending through said fork body and said assist blade and wherein said spring means is a coil spring positioned on said pivot pin and hooked around said fork body and against said assist blade.

8. The fork of claim 1 wherein said blade has a second portion formed at a substantially right angle to the lower edge of said portion extending above the level of said tine upper surfaces;

said second portion underlying and being coextensive with a portion of the lower surface of said outer tine when said blade is in said second position, to minimize food droppage between said blade and said outer tine.

* * * * *